United States Patent [19]

Zanias et al.

[11] Patent Number: 4,613,297

[45] Date of Patent: Sep. 23, 1986

[54] VENT FLOW MONITOR

[75] Inventors: Theodore J. Zanias, Huntington Beach; Elwood M. Fairchild, Los Angeles, both of Calif.

[73] Assignee: Masco Corporation, Taylor, Mich.

[21] Appl. No.: 651,341

[22] Filed: Sep. 17, 1984

[51] Int. Cl.[4] ..... F23N 5/24

[52] U.S. Cl. ..... 431/16; 126/116 A; 126/307 R; 126/312 A

[58] Field of Search ..... 431/16, 22; 126/116 A, 126/77, 112, 851, 307 R, 307 A; 200/81.9 R, 81.9 HG, 81.9 M

[56] References Cited

U.S. PATENT DOCUMENTS

| | | | |
|---|---|---|---|
| Re. 28,013 | 5/1974 | McLarty . | |
| 1,183,787 | 5/1966 | Welch et al. . | |
| 1,799,758 | 3/1931 | Mayr . | |
| 2,112,554 | 3/1938 | Beam . | |
| 2,694,194 | 11/1954 | Gilletto . | |
| 2,913,044 | 11/1959 | Mobley . | |
| 3,005,887 | 10/1961 | Robson | 200/81.9 R |
| 3,273,625 | 9/1966 | Holtzman et al. . | |
| 3,403,962 | 10/1968 | Suffron et al. . | |
| 3,431,056 | 3/1969 | Winegardner . | |
| 3,542,018 | 11/1970 | Quick . | |
| 3,768,956 | 10/1973 | Mueller et al. . | |
| 3,918,880 | 11/1975 | Risse . | |
| 4,102,627 | 7/1978 | Reed et al. . | |
| 4,249,883 | 2/1981 | Woolfolk . | |
| 4,289,271 | 9/1981 | Barth . | |
| 4,343,288 | 8/1982 | Tjosvold | 126/77 |
| 4,401,425 | 8/1983 | Gable et al. . | |
| 4,406,396 | 9/1983 | Habegger . | |

FOREIGN PATENT DOCUMENTS 2105888 3/1983 United Kingdom .

OTHER PUBLICATIONS

Dwyer (Publication) "Air Velocity Measurement" pp. 2 & 3, Copyright 1978, Dwyer Instruments.

*Primary Examiner*—Carroll B. Dority, Jr.

*Attorney, Agent, or Firm*—Steven L. Permut; Malcolm L. Sutherland; Leon E. Redman

[57] ABSTRACT

A monitor for a gas appliance vent includes a conduit section that is mounted in line with a vent leading from a furnace or other gas appliance. The conduit section has an interior tubular plenum member which extends across the vent interior. The tubular plenum member has upstream facing openings therein. An outer end of the tubular member passes through an aperture in the conduit section. The outer end is open to allow flow therethrough from the upstream facing openings. A switch is mounted in proximity to the outer end. The switch is thermally responsive to respond to the heated flue gases that flow out the outer end. The switch is operably connectable to either an alarm or a fuel line shut off valve.

7 Claims, 7 Drawing Figures

VENT FLOW MONITOR

TECHNICAL FIELD

This invention relates to a vent monitor system for a gas appliance and the like.

DISCLOSURE INFORMATION

Gas appliances such as furnaces and water heaters are often designed with a draft hood at the base of the vent or within the appliance housing itself. If the vent is accidentally blocked or otherwise has inadequate venting capabilities, the draft hood relief port provides for the ready escape fo the flue gases therefrom. However, the flue gas spillage condition should be remedied as soon as possible to prevent the flue gases from accumulating within the building. Consequently, switches have been devised which are placed in or near the draft hood relief opening to detect spillage conditions and shut off the gas fuel line if a spillage condition is sensed. However, these switches have not met commercial success due to three major problems. Firstly, there is often difficulty, particularly on existing appliance installations, in finding a proper location to attach the switch in the draft hood. Secondly, field installations are not controllable and often the field installations may detrimentally affect the appliance operation. Furthermore, if the heat is shut off followed by no prompt remedy, the risk of frozen or broken water lines within the unheated house becomes significant.

Attempts have been made to use sail switches within the vent to indicate proper vent flow. If the flow is improper, the sail switch pivots to a spill indicating position. However, sail switches have practical problems in that they have fractional bearing surfaces that are sensitive to corrosion and particulate build-up that prevent them from operating in their intended fashion. Furthermore, their accuracy is relatively poor.

Devices have been used that monitor the static pressure within the vent. The static pressure is monitored through an aperture in the wall of the vent. A thermal responsive switch is mounted in proximity to the aperture and senses if heated flue gases spill out of the aperture. However, the problem with this monitor is that it is only sensitive to static pressure within the vent. It is known that the static pressure within the vent can remain negative while the pressure within the draft hood could be positive. Consequently, these static pressure sensors do not correctly correlate with the spillage conditions at the appliance draft hood.

Monitors have also been used for power vents. See U.S. Pat. No. 3,768,956 issued to Mueller et al on Oct. 30, 1973 which discloses a tube which has upwardly facing holes therein. The tube senses the partial vacuum (or lack thereof) within the vent due to a blockage downstream or upstream of the monitor. A pressure responsive switch is mounted in proximity to the outer end of the tube.

What is needed is a monitor for a gravity vent that more accurately and dependably determines when there is sufficient flow in the vent to prevent prolonged draft hood spillage. A monitor is needed that has no moving parts within the vent. What is also needed is a monitor that can be attached to the vent without modification to the appliance or draft hood.

SUMMARY OF THE INVENTION

In accordance with one aspect of the invention, a vent flow monitor for a gas appliance, for example furnace, includes a conduit section that has an upsteam end that is affixable to the draft outlet of the gas appliance and a downstream end that is connectable to a vent. The conduit section has an aperture therethrough. A plenum is positioned in proximity to the aperture and has an outer end in direct communication with the aperture and has openings facing upstream within the conduit section. The plenum is constructed to have a static pressure that is the sum of the negative static pressure and a fraction of the positive velocity pressure in the vent outside of the plenum. The plenum can be formed by a hollow tubular member having one closed end or be more opened and defined in part by a shroud or plate positioned immediately downstream from the aperture through the conduit.

A switch is mounted to the exterior of the conduit section and is positioned in proximity to the outer end of the plenum with the switch being responsive to the presence of heated flue gases flowing out of the outer end. The switch is operably connectable to an alarm or a fuel line shut off valve.

According to another aspect of the invention, a monitor for a vent includes a tubular member extending through the vent in proximity to a draft hood of a gas appliance with at least one opening facing upstream within the vent. The tubular member has an open outer end passing through the vent. A switch is mounted in proximity to the outer end and is responsive to the presence of the heated flue gases flowing out of the outer end of the tubular member.

In another embodiment, the tubular member has a relief opening on a downstream side of the tubular member. The relief opening has a smaller area than the upstream facing opening or openings.

In another embodiment, the tubular member has a bent section which extends upstream from the upstream facing opening to the outer end. Preferably, the bent section extends upstream within the conduit section.

Preferably the switch that responds to the heated flue gases flowing out of the outer end of the tubular member is thermally responsive.

In this fashion, a device within a vent downstream from the appliance draft hood can accurately detect conditions which cause flue gas spillage from the draft hood. If this condition is sensed for more than a momentary period of time, the monitor can either initiate an alarm signal or cut off the fuel flow to the appliance. The device has no moving parts within the vent that would cause maintenance problems.

BRIEF DESCRIPTION OF THE DRAWINGS

Reference now is made to the accompanying drawings in which.

DETAILED DESCRIPTION OF THE PREFERRED EMBODIMENT

Figure 1:
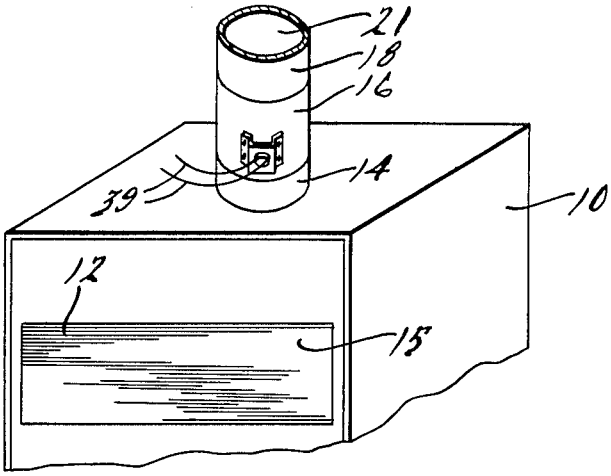
FIG. 1 is a perspective view of a furnace with a vent flow monitor attached to the vent above the furnace according to the invention.

Referring to FIG. 1, a furnace 10 has a draft hood 12 and a collar 14 forming an outlet for the draft hood 12. The draft hood 12 also has a port 15 that is open to the ambient atmosphere. A vent flow monitor 16 is mounted to collar 14 and to vent 18. The vent 18 is a gravity vent and does not have any fans therein to force flow therethrough.

Figure 2:
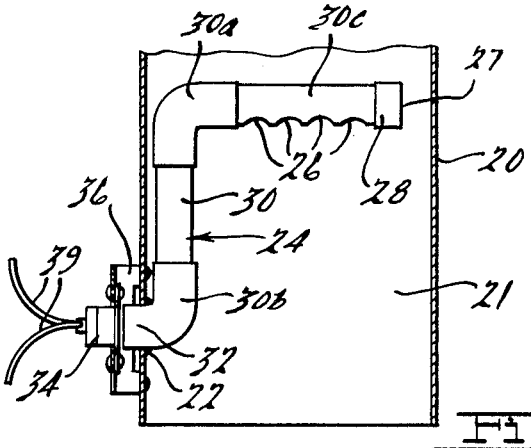
FIG. 2 is an enlarged partially segmented side elevational view of one embodiment of the vent flow monitor shown in FIG. 1.
Figure 3:
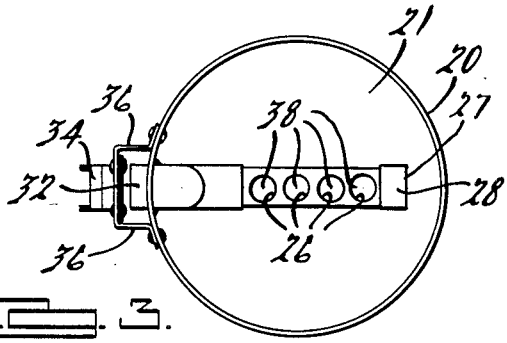
FIG. 3 is a bottom plan view of the monitor shown in FIG. 2.

Referring to FIGS. 2 and 3, the monitor 16 includes a conduit section 20 that has its upstream end connected to collar 14 and its downstream end to vent 18. The conduit can have an inner diameter of approximately $3\frac{3}{4}$ inches. The conduit section 20 has an aperture 22 therethrough. A tubular member 24 having an inner diameter of approximately 0.55 inch is mounted to conduit section 20 and has a plurality of openings 26 which face upstream within the vent interior 21. On a radially opposing side of the tubular member 24, inner surface areas 38 are exposed to the flow through inlets 26. The inner end 27 of tubular member 24 is closed with cap 28. The member 24 has a section 30 which extend upstream from inlets 26 turned portion 30*a* to turned portion 30*b*. Outer end 32 of the tube 24 extends through the aperture 22. Tubular member 24 has a portion 30*c* extending transverse of flow through the vent.

A thermally responsive switch 34, for example, Elmwood Sensors model 2450, is mounted onto a bracket 36 which in turn is mounted on the exterior side of conduit section 20. The sensor switch 34 is mounted in proximity to the outer open end 32 of tubular member 24. Support bracket 36, as more clearly shown in FIG. 3, is designed to restrict heat flow from being conducted from conduit section 20 to switch 34 and to act as a heat sink to reduce the effect of momentary spillage conditions which would otherwise set off switch 34. A switch 34 has leads 39 which are operably connected to either an alarm or to a fuel shut-off valve. The alarm can be in a remote location such as a kitchen or living room. However, it is also contemplated that the alarm can be battery operated and mounted onto the conduit section 20 to form a complete self-contained unit.

In operation, under normal circumstances when the appliance first becomes activated, there may be a small amount of flue gases entering openings 26 and spilling out of outer end 32. However, the time delay of the heat responsive switch 34 is sufficiently long that it does not activate by the initial small spillage of the gases which can occur until adequate gravity flow is established. Afterwards, the flow within the vent 21 is sufficient under normal circumstances so that the static pressure in the tube 24 is negative such that air normally flows into outer end 32, through the tubular member 24, to openings 26, and into vent interior 21. During this mode, the switch 34 remains inactive.

If perchance there is a blockage within the vent interior 21, or other reduced flow conditions exist which might allow the flue gases to pass through openings 26, through section 30 and out through outer end 32 for more than a momentary period of time; switch 34 then responds to the heated flue gases and activates. The appropriate alarm is then sounded or the fuel line shut-off valve shuts off the flow of fuel.

The static pressure within the tube 24 is affected by the velocity pressure within the conduit section 20. Therefore the sensor more accurately and dependably monitors the conditions within the vent interior 21 that correspond to conditions in the draft hood that would cause spillage from the draft hood 12.

The openings 26 extend along a substantial portion of the diameter of the vent interior 21. With the openings 26 spaced along the diameter, the monitor is sensitive to an average pressure rather than a pressure at a specific point within the vent interior 21. Since velocity pressure within the vent varies from along the inner surface of conduit section 20 to the radial center of the vent interior 21, the sensing at one point rather than at another can have a significant variance with how the monitor 16 reacts. An average velocity pressure taken at the vent interior 21 more accurately corresponds to the conditions within the draft hood 12 that can cause spillage therefrom.

Figure 4:
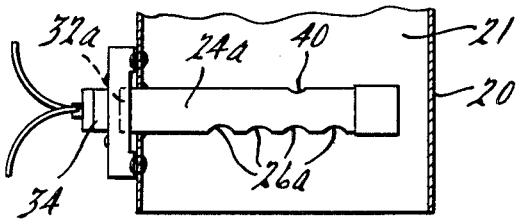
FIG. 4 is a view similar to FIG. 2 showing a second embodiment.
Figure 5:
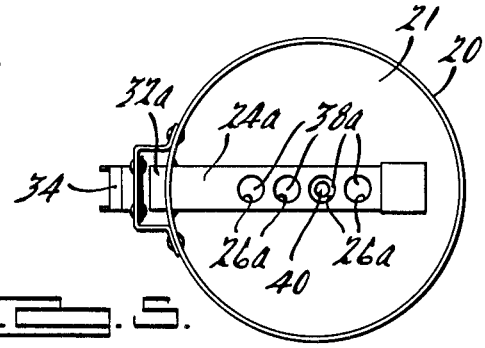
FIG. 5 is a bottom plan view of the embodiment as shown in FIG. 4.

FIGS. 4 and 5 illustrate a second embodiment which has a straight tubular member 24*a* having a plurality of openings 26*a* and a single relief opening 40 that faces downstream within vent interior 21. Relief opening 40 is aligned directly over one of the openings 26*a*. In addition, the sum of the areas of openings 26*a* is substantially greater than the area of relief opening 40. For example, each of four openings 26*a* has a diameter of $\frac{1}{4}''$ and the single relief opening 40 has a diameter of $\frac{1}{8}''$. The ratio of the open areas is approximately sixteen to one. The four openings 26*a* are spaced over $1\frac{1}{4}''$ apart. Inner surface areas 38*a* face upstream and are exposed to the flow through openings 26*a*. Tubular member 24*a* has its outer open end 32*a* face thermally responsive switch 34.

It is believed that the relief opening 40 provides for a monitor that accounts for all the static pressure and a fraction of the velocity pressure within the conduit 20. Normally, the static pressure within the tube 24*a*, (which is the addition of the negative static pressure and the fractional amount of positive velocity pressure within the conduit 20) is negative and ambient air flows into outer end 32*a*. However, when the static pressure within tube 24*a* is positive, flue gases flow through tubular member 24*a* and through its outer open end 32*a* to the thermal responsive switch 34.

Figure 6:
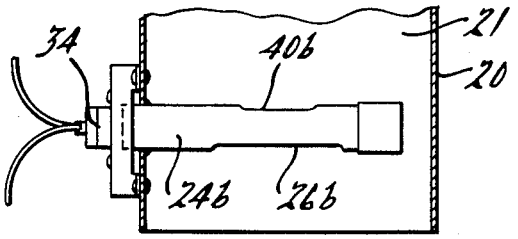
FIG. 6 is a view similar to FIG. 2 showing a third embodiment.
Figure 7:
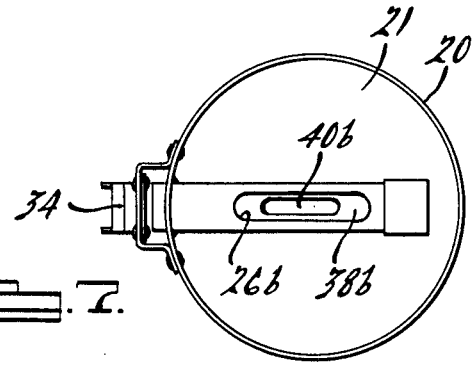
FIG. 7 is a bottom plan view of the emobdiment shown in FIG. 6.

FIGS. 6 and 7 disclose a third embodiment in which tubular member 24*b* has an upstream facing slot 26*b* that extends across a substantial portion of vent interior 21. A relief slot 40*b* faces downstream and is sized to be smaller than slot 26*b* such that exposed surface area 38*b* faces downstream. The slot 26*b* can be $1\frac{1}{2}'' \times \frac{1}{2}''$ and slot 40*b* can be $1\frac{3}{8}'' \times \frac{1}{8}''$. Therefore, the ratio of the area of the slots 26*b* and 40*b* is roughly two to one. The operation of the third embodiment is the same as the second embodiment.

Furthermore, in the second and third embodiments, if soot buildup occurs at the vent interior 21, the smaller relief openings 40 and 40*b* would tend to clog first or at the same rate as the larger openings 26*a* and 26*b* thereby making the monitor 16 more sensitive which would tend to activate the switch at a condition further from the conditions that cause spillage. This early signal is an indication of soot buildup and that cleaning of the vent interior 21 and monitor 16 is needed. Furthermore, the appliance should be checked for a faulty combustion process.

In this fashion, a flow monitor is positioned in a vent that can sense conditions in the vent that cause spillage conditions at the draft hood relief port. The monitor has no moving parts which could be adversely affected by weight or friction due to bearing surfaces.

Furthermore, the monitor is contained within a conduit section 20 that can be easily attached to the vent 18 and an appliance collar 14. The conduit section provides for an easily installable device that can be used either with new vent systems or easily installed to existing systems without any modifications to the appliance 10, i.e. the integrity of the appliance remains intact.

Variations and modifications of the present invention are possible without departing from its scope and spirit as defined by the appended claims.

The embodiments of the invention in which an exclusive property or privilege is claimed are defined as follows:

1. A vent flow monitor for an appliance characterized by:

a tubular member extending through an opening in a wall of a vent in proximity to said appliance;

said tubular member having a first turned portion and a second turned portion downstream of said first turned portion, and a first turbular portion connecting said first and second turned portions, and a second tubular portion connected to said second turned portion and extending transverse of flow through said vent, said second tubular portion having at least one opening facing upstream in said vent;

said tubular member having an outer end positioned on the exterior side of the wall of said vent;

a switch means mounted in proximity to said outer end and being responsive to the presence of heated flue gases flowing out of said outer end of said tubular member; and said switch means being operably connectable to an alarm indicator or a fuel shut off valve of said appliance.

2. A monitor as defined in claim 1 wherein:

at least one opening includes a plurality of apertures spaced across a significant portion of the vent interior.

3. A monitor as defined in claim 1 wherein:

said switch means is thermally responsive and responds to the heat of the flue gases flowing out of the outer end of said tubular member.

4. A monitor for sensing conditions in a vent that correspond to spillage conditions or near spillage conditions at a draft hood, said monitor characterized by:

means forming a plenum within said vent having an outer end in pressure communication with ambient atmosphere about said vent, said plenum extending transverse of flow through said vent and including at least one opening facing upstream of flow through said vent, a relief opening on an opposite side of said plenum from said at least one opening, said relief opening being of smaller area then said at least one opening, switch means mounted in proximity to said outer end of said plenum and being responsive to activate when the static pressure within said plenum is positive; and said switch being operably connectable to an alarm or fuel shut off valve.

5. A monitor as defined in claim 4 wherein:

said at least one opening comprises a slot that extends across a significant portion of the vent interior.

6. A monitor as defined in claim 4 further characterized by:

said switch means being thermally responsive and responds to the heat of the flue gases flowing out of the outer end of the plenum.

7. A monitor as defined in claim 4 wherein:

said at least one upstream facing opening includes a plurality of apertures spaced across a significant portion of the vent interior.

* * * * *